US011312552B2

(12) United States Patent
Blehm et al.

(10) Patent No.: US 11,312,552 B2
(45) Date of Patent: Apr. 26, 2022

(54) ARTICLE CARRIER AND BLANK THEREFOR

(71) Applicant: WestRock Packaging Systems, LLC, Atlanta, GA (US)

(72) Inventors: Elina Blehm, Herl (DE); Daniel Lichter, Trierweiler (DE); Rudolf Warscheid, Trier (DE)

(73) Assignee: WESTROCK PACKAGING SYSTEMS, LLC, Atlanta, GA (US)

( * ) Notice: Subject to any disclaimer, the term of this patent is extended or adjusted under 35 U.S.C. 154(b) by 257 days.

(21) Appl. No.: 16/638,264

(22) PCT Filed: Aug. 10, 2018

(86) PCT No.: PCT/US2018/046244
§ 371 (c)(1),
(2) Date: Feb. 11, 2020

(87) PCT Pub. No.: WO2019/036294
PCT Pub. Date: Feb. 21, 2019

(65) Prior Publication Data

US 2020/0198865 A1 Jun. 25, 2020

Related U.S. Application Data

(60) Provisional application No. 62/545,057, filed on Aug. 14, 2017.

(51) Int. Cl.
*B65D 71/58* (2006.01)

(52) U.S. Cl.
CPC .. *B65D 71/0022* (2013.01); *B65D 2571/0045* (2013.01); *B65D 2571/0066* (2013.01);
(Continued)

(58) Field of Classification Search
CPC ..... B65D 71/0022; B65D 2571/00141; B65D 2571/00388; B65D 2571/0045;
(Continued)

(56) References Cited

U.S. PATENT DOCUMENTS 2,772,020 A 11/1956 Kramer
2,974,827 A 3/1961 Levkoff
(Continued)

FOREIGN PATENT DOCUMENTS

EP 0946395 B1 4/2002
EP 1365970 B1 8/2006
(Continued)

*Primary Examiner* — Jacob K Ackun
(74) *Attorney, Agent, or Firm* — Neil G. Cohen; Brian J. Goldberg

(57) ABSTRACT

A carrier (190, 90) comprising a plurality of main panels (18, 20, 22, 24, 26) forming outer walls and defining an interior chamber, the plurality of main panels comprise a first side panel (20, 120), a second side panel (24, 124), first end panel (18, 118), second end panel (64, 164), third end panel (70, 170) and fourth end panel (82, 182). The first and fourth end panels form a composite end wall of the carrier. The second and third end walls form a second composite end wall of the carrier. The second end wall is hingedly connected to the third end wall by a first fold line (21, 121). The interior chamber is divided into two or more cells by a partition structure. The partition structure comprises a first handle panel (14, 114) hingedly connected along a first side edge to an end panel.

20 Claims, 10 Drawing Sheets

(52) U.S. Cl.
CPC ..... *B65D 2571/0087* (2013.01); *B65D 2571/00141* (2013.01); *B65D 2571/00388* (2013.01); *B65D 2571/00487* (2013.01); *B65D 2571/00524* (2013.01); *B65D 2571/00783* (2013.01); *B65D 2571/00932* (2013.01)

(58) Field of Classification Search
CPC ..... B65D 2571/00487; B65D 2571/00524; B65D 2571/0066; B65D 2571/00783; B65D 2571/0087; B65D 2571/00932
See application file for complete search history.

(56) References Cited

U.S. PATENT DOCUMENTS

| | | | | |
|---|---|---|---|---|
| 3,098,583 | A | 7/1963 | Sherman et al. | |
| 3,104,027 | A | 9/1963 | Kulig | |
| 3,211,357 | A | 10/1965 | Weiss | |
| 3,283,989 | A | 11/1966 | De Paul | |
| 4,187,944 | A | 2/1980 | Wood | |
| 4,330,078 | A | 5/1982 | Graser | |
| 5,516,034 | A | 5/1996 | Jensen et al. | |
| 5,979,645 | A | 11/1999 | Holley, Jr. | |
| 6,003,665 | A | 12/1999 | Stout | |
| 6,102,197 | A * | 8/2000 | Negelen | B65D 71/0022 206/193 |
| 6,598,739 | B1 | 7/2003 | Collura | |
| 8,297,437 | B2 * | 10/2012 | Smalley | B65D 71/0022 206/170 |
| 9,415,914 | B2 | 8/2016 | Holley, Jr. | |
| 2002/0179459 | A1 | 12/2002 | Bakx | |
| 2005/0103651 | A1 * | 5/2005 | Lebras | B65D 71/0055 206/162 |
| 2007/0199836 | A1 | 8/2007 | Cuomo | |
| 2015/0246746 | A1 * | 9/2015 | Brand | B65D 5/48002 229/117.13 |
| 2016/0152389 | A1 | 6/2016 | Holley, Jr. | |
| 2017/0297795 | A1 * | 10/2017 | Zacherle | B65D 5/4608 |
| 2019/0047763 | A1 * | 2/2019 | Holley, Jr. | B65D 71/0022 |

FOREIGN PATENT DOCUMENTS

| | | | |
|---|---|---|---|
| EP | 1369247 | B1 | 5/2012 |
| EP | 2433878 | B1 | 11/2013 |
| EP | 2534064 | B1 | 4/2016 |
| WO | WO 02/068280 | A2 | 9/2002 |
| WO | WO 2006/065941 | A2 | 6/2006 |
| WO | WO2007/092348 | A2 | 8/2007 |
| WO | WO2011/133851 | A2 | 10/2011 |

* cited by examiner

ARTICLE CARRIER AND BLANK THEREFOR

CROSS-REFERENCE TO RELATED APPLICATIONS

This application is a National Phase application of PCT Application PCT/US2018/46244, filed Aug. 10, 2018, which claims the benefit of U.S. Provisional Patent Application No. 62/545,057, filed Aug. 14, 2017, which is incorporated herein by reference in its entirety.

TECHNICAL FIELD

The present invention relates to a carrier and to a blank for forming the carrier. More specifically, but not exclusively, the invention relates to a carrier of the basket-style wherein a medial partition divides the carrier into at least two cells, in some embodiments a carrying handle is provided from multiple plies of sheet material.

BACKGROUND

In the field of packaging it is known to provide basket style article carriers for carrying multiple articles. Basket style article carriers are well known in the art and are useful for enabling consumers to transport, store and access a group of articles for consumption. These carriers typically have a handle on top, such that the carrier mimics a conventional basket, and typically include a riser or medial partition from which the handle is fashioned.

For cost and environmental considerations, such cartons or carriers need to be formed from as little material as possible and cause as little wastage in the materials from which they are formed as possible this may include reducing or minimising the thickness or caliper of the sheet material from which the carrier is formed. Further considerations are the strength of the carrier; its suitability for holding and transporting large weights of articles; and the aesthetic appeal of the carrier which, if eye-catching and appealing to a consumer, may promote increased sales.

The present invention seeks to provide an improvement in the field of basket-style article carriers, typically formed from paperboard or the like.

SUMMARY

According to a first aspect of the present disclosure there is provided a carrier comprising a plurality of main panels forming outer walls and defining an interior chamber. The plurality of main panels comprises a first side panel, a second side panel, first end panel, second end panel, third end panel and fourth end panel. The first and fourth end panels form a first end wall of the carrier. The second and third end panels form a second end wall of the carrier. The second end panels is hingedly connected to the third end panel by a first fold line. The interior chamber is divided into two or more cells by a partition structure. The partition structure comprises a handle panel hingedly connected along a first side edge to the first end panel. The partition structure comprises a securing panel hingedly connected to the handle panel along a second opposing side edge of the first handle panel by a second fold line. A partition panel is hingedly connected to the fourth end panel. The handle panel and second partition panel together may form a medial partition and each may comprise a handle opening for forming a carrying handle in the medial partition. The securing panel is secured to the third end panel. The second fold line is offset from the first fold line, when the carrier is in a flat collapsed form.

Optionally, the second fold line is interrupted by at least one aperture or cutaway, the cutaway being disposed in overlying relationship with the first fold line when the carrier is in a flat collapsed form.

Optionally, the second fold line is offset from the first fold line by a distance x, where the distance x is in the range 0.75 mm to 3 mm.

Optionally, the partition panel is hingedly connected to fourth end panel.

Optionally, the partition panel is hingedly connected to a bridging panel, the bridging panel being secured to the fourth end panel, and at least in blank form hingedly connected thereto.

Optionally, the carrier comprises a further partition panel hingedly connected to the handle panel along an end edge of the handle panel adjacent the first and second side edges.

Optionally, the carrier comprises a further handle panel hingedly connected to a bridging panel, the bridging panel being secured to the fourth end panel, and at least in blank form hingedly connected thereto.

Optionally, the first partition panel comprises at least one divider, wherein the at least one divider comprises a divider panel, hingedly connected to the first partition panel and struck, at least in part, therefrom, and a securing tab hingedly connected to the divider panel.

Optionally, the second partition panel comprises at least one divider wherein the at least one divider comprises a divider panel, hingedly connected to the first partition panel and struck, at least in part, therefrom, and a securing tab hingedly connected to the divider panel.

Optionally, the carrier comprises a first base panel hingedly connected to the first side panel.

Optionally, the carrier comprises a second base panel hingedly connected to the second side panel.

Optionally, the carrier comprises a securing flap hingedly connected to the second side panel.

Optionally, the first base panel comprises a fold line extending longitudinally thereacross forming a first proximal part and a second distal part, the second distal part being secured to the securing flap such that the base panel is automatically erected when the carrier is erected from a flat collapsed form.

Optionally, the carrier comprises a second handle panel hingedly connected to the second end panel and to the fourth end panel by a bridging panel.

Optionally, the second handle panel comprises a handle opening.

Optionally, the first handle panel comprises a cutaway struck therefrom and separating or spacing apart the divider panel from the first handle panel; the divider panel being struck in part from the first handle panel.

Optionally, the first handle panel comprises a first catch, defined by a recess, the securing panel comprising a first catch reinforcement defined by a recess, the first catch reinforcement hingedly connected to the first handle panel adjacent the first catch and severable from an upper portion of the securing panel by a severable line.

Optionally, the first handle panel comprises an embossed region for being adhered directly to the second handle panel.

Optionally, the second partition panel is shorter in a longitudinal direction than the first or second handle panels.

Optionally, the first end panel comprises a locking tab struck from an adjacent portion of the first handle panel to which the first end panel is hinged, and the fourth end panel comprises an opening for receiving the locking tab.

Optionally, the opening is defined by a portion of a divider, said portion being struck from the fourth end panel.

According to a second aspect of the present disclosure there is provided an article carrier comprising:

a tubular structure having a plurality of outer walls defining an interior volume for receiving one or more articles, the plurality of outer walls including first and second opposed side walls, first and second opposed end walls and a base wall;

a medial partition structure coupled to the tubular structure; and a carrying handle formed in the medial partition structure, wherein the medial partition is formed from at least two plies, a first ply provided by a first handle panel and a second ply provided by a first partition panel, the first partition panel hinged to a lower edge of the first handle panel, the first partition panel comprising at least one divider, wherein the at least one divider comprises a divider panel hingedly connected to the first partition panel and struck, at least in part, therefrom, and a securing tab hingedly connected to the divider panel, first handle panel comprising a cutaway struck therefrom and separating or spacing apart the divider panel from the first handle panel.

Optionally, the divider panel is struck in part from the first handle panel.

According to a third aspect of the present disclosure there is provided an article carrier comprising:

a tubular structure having a plurality of outer walls defining an interior volume for receiving one or more articles, the plurality of outer walls including first and second opposed side walls, first and second opposed end walls and a base wall;

a medial partition structure coupled to the tubular structure; and a carrying handle formed in the medial partition structure;

wherein the medial partition is formed from at least three plies, a first ply provided by a first handle panel, a second ply provided by a partition panel and a third ply provided by a second handle panel, the partition panel being disposed between a first portion of the first handle panel and a first portion of the second handle panel and a second portion of the of the first handle panel and a second portion of the second handle panel are secured directly to each other, one of the first and second handle panels comprising an embossed region disposed in face contacting relationship with a corresponding region of the other of the first and second handle panels.

According to a fourth aspect of the present disclosure there is provided a blank for forming an article carrier, the blank comprising:

a plurality of main panels forming outer walls and defining an interior chamber, plurality of main panels comprising a first side panel, a second side panel, first end panel, second end panel, third end panel and fourth end panel, the first and fourth end panels forming a composite end wall of the carrier, the second and third end walls forming a composite end wall of the carrier, the second end wall being hingedly connected to the third end wall by a first fold line;

one or more panels for forming a medial partition structure for dividing the interior chamber into two or more cells, which one or more panels are configured and arranged such that once the blank is assembled into a carrier, the medial partition structure is connected to the tubular structure, wherein the one or more panels include:

a first handle panel hingedly connected along a first side edge to an end panel;

a securing panel hingedly connected to the first handle panel along a second opposing side edge of the first handle panel by a second fold line;

a first partition panel hingedly connected to the first handle panel along an end edge adjacent the first and second side edges; and a second partition panel hingedly connected to a fourth end panel;

wherein the first handle panel, the first partition panel and the second partition panel each comprise a handle opening for forming a carrying handle in the medial partition structure; and wherein the securing panel is configured for being secured to the third end panel such that the second fold line is offset from the first fold line, when the blank is folded into in a flat collapsed form.

According to a fifth aspect of the present disclosure there is provided a blank for forming an article carrier, the blank comprising:

a plurality of panels for forming a plurality of outer walls of a tubular structure of the carrier and defining an interior volume for receiving one or more articles, the plurality of outer walls including first and second opposed side walls, first and second opposed end walls and a base wall;

one or more panels for forming a medial partition structure, which one or more panels are configured and arranged such that once the blank is assembled into a carrier, the medial partition structure is connected to the tubular structure;

wherein the one or more panels for forming a medial partition structure comprise handle features for forming a carrying handle in the medial partition structure; and wherein the medial partition structure is formed from at least two plies, a first ply provided by a first handle panel and a second ply provided by a first partition panel, the first partition panel hinged to a lower edge of the first handle panel, the first partition panel comprising at least one divider, the at least one divider comprising:

a divider panel hingedly connected to the first partition panel and struck, at least in part, therefrom; and a securing tab is hingedly connected to the divider panel;

wherein the first handle panel comprises a cutaway struck therefrom and separating or spacing apart the divider panel from the first handle panel.

According to a sixth aspect of the present disclosure there is provided a blank for forming an article carrier, the blank comprising:

a plurality of panels for forming a plurality of outer walls of a tubular structure of the carrier and defining an interior volume for receiving one or more articles, the plurality of outer walls including first and second opposed side walls, first and second opposed end walls and a base wall;

one or more panels for forming a medial partition structure, which one or more panels are configured and arranged such that once the blank is assembled into a carrier, the medial partition structure is connected to the tubular structure;

wherein the one or more panels for forming a medial partition structure comprise handle features for forming a carrying handle in the medial partition structure; and wherein the medial partition is formed from at least three plies, a first ply provided by a first handle panel, a second ply provided by a partition panel and a third ply provided by a second handle panel, the partition panel being configured to be disposed between a first portion of the first handle panel and a first portion of the second handle panel and a second portion of the of the first handle panel and a second portion of the second handle panel arranged to be secured directly to each other, one of the first and second handle panels comprising an embossed region disposed in face contacting relationship with a corresponding region of the other of the first and second handle panels.

According to a seventh aspect of the present disclosure there is provided a carrier comprising a plurality of main panels forming outer walls and defining an interior chamber, the plurality of main panels comprising a first side panel, a second side panel, first end panel, second end panel, third end panel and fourth end panel, the first and fourth end panels forming a first end wall of the carrier, the second and third end panels forming a second end wall of the carrier, the second end panel being hingedly connected to the third end panel by a first fold line, the interior chamber divided into two or more cells by a partition structure, the partition structure comprising a handle panel coupled to the first end wall, the partition structure comprising a securing panel secured to the second end wall, the securing panel being hingedly connected to the handle panel along a second opposing side edge by a second fold line and wherein a partition panel is coupled to the first end wall, the handle panel, and the partition panel together forming a medial partition and each comprising a handle opening for forming a carrying handle in the medial partition, wherein the second fold line is offset from the first fold line, when the carrier is in a flat collapsed form.

According to an eighth aspect of the present disclosure there is provided a blank for forming an article carrier, the blank comprising:

a plurality of main panels forming outer walls and defining an interior chamber, the plurality of main panels comprising a first side panel, a second side panel, first end panel, second end panel, third end panel and fourth end panel, the first and fourth end panels forming a first end wall of the carrier, the second and third end panels forming a second end wall of the carrier, the second end panel being hingedly connected to the third end panel by a first fold line, one or more panels for forming a medial partition structure for dividing the interior chamber into two or more cells, which one or more panels are configured and arranged such that once the blank is assembled into a carrier the medial partition structure is connected to the tubular structure, the one or more panels including:

a handle panel hingedly connected along a first side edge to the first end panel;

a securing panel hingedly connected to the handle panel along a second opposing side edge by a second fold line; and a partition panel coupled to the fourth end panel;

the handle panel and the partition panel together forming a medial partition and each comprising a handle opening for forming a carrying handle in the medial partition;

the securing panel being secured to the third end panel; and wherein the second fold line is offset from the first fold line, when the carrier is in a flat collapsed form.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
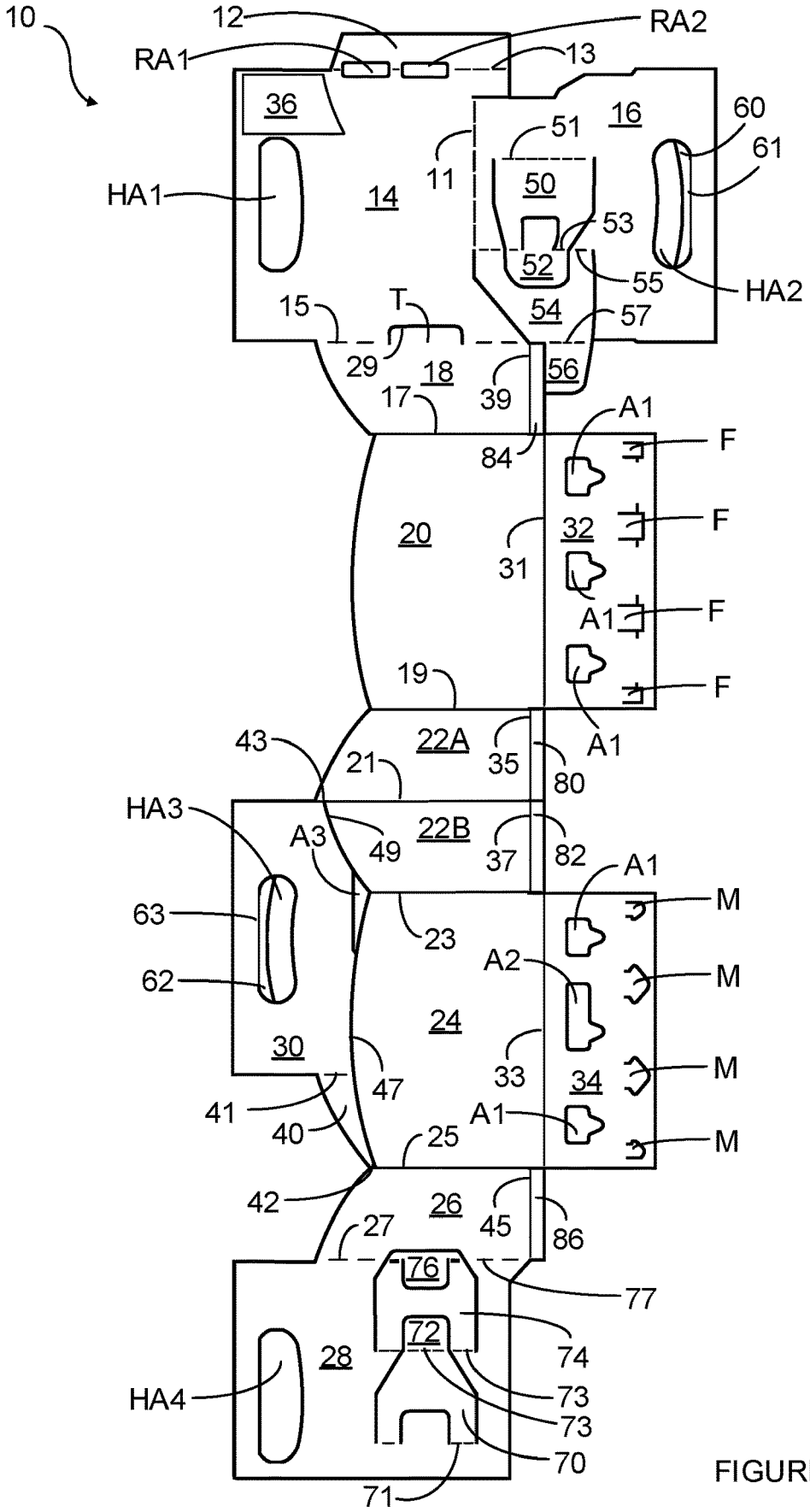
FIG. 1 is a plan view from above of a blank for forming a carrier according to a first embodiment.
Figure 7:
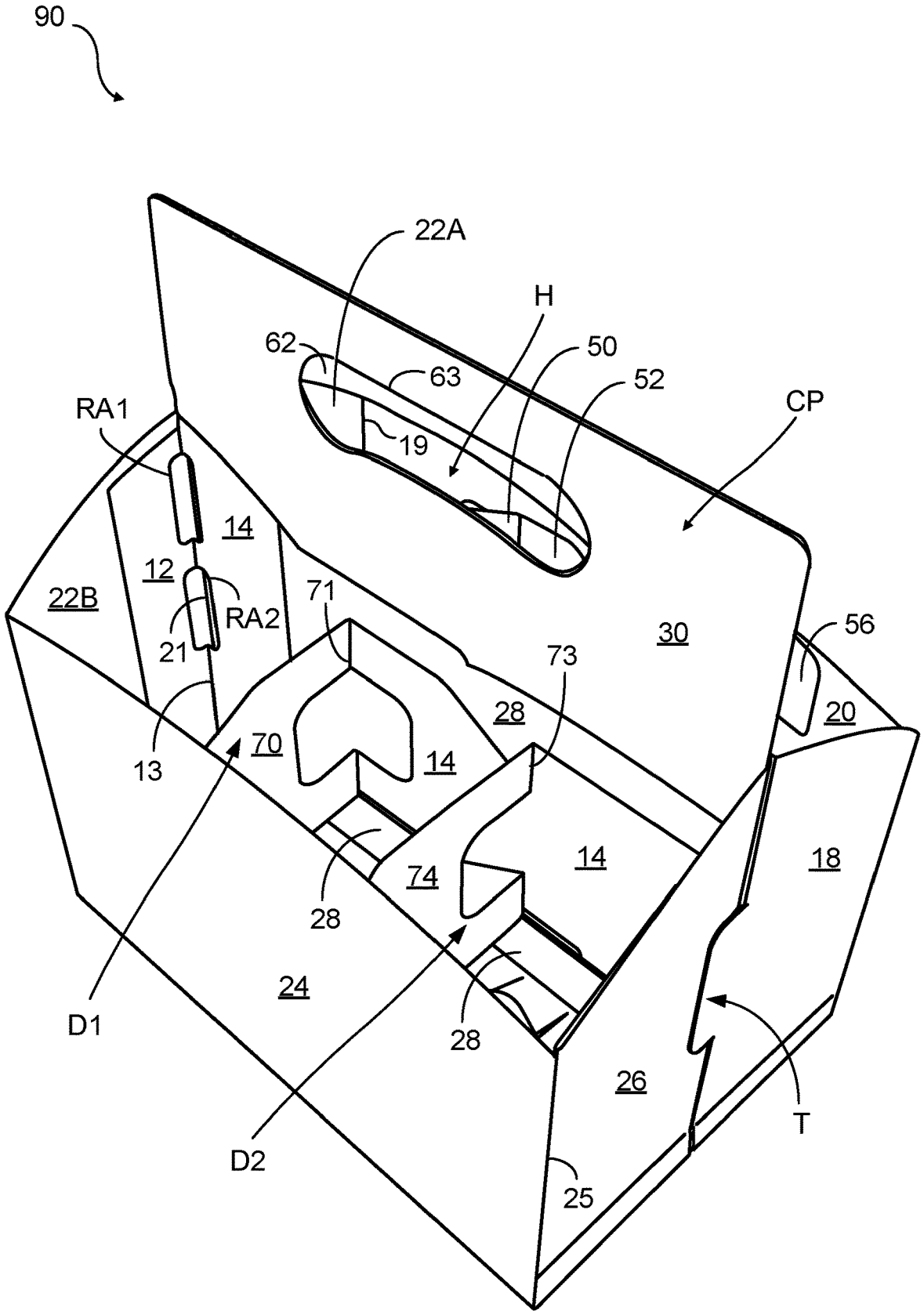
FIG. 7 is a perspective view from above of a front end wall and a first side of a carrier formed from the blank of FIG. 1.
Figure 8:
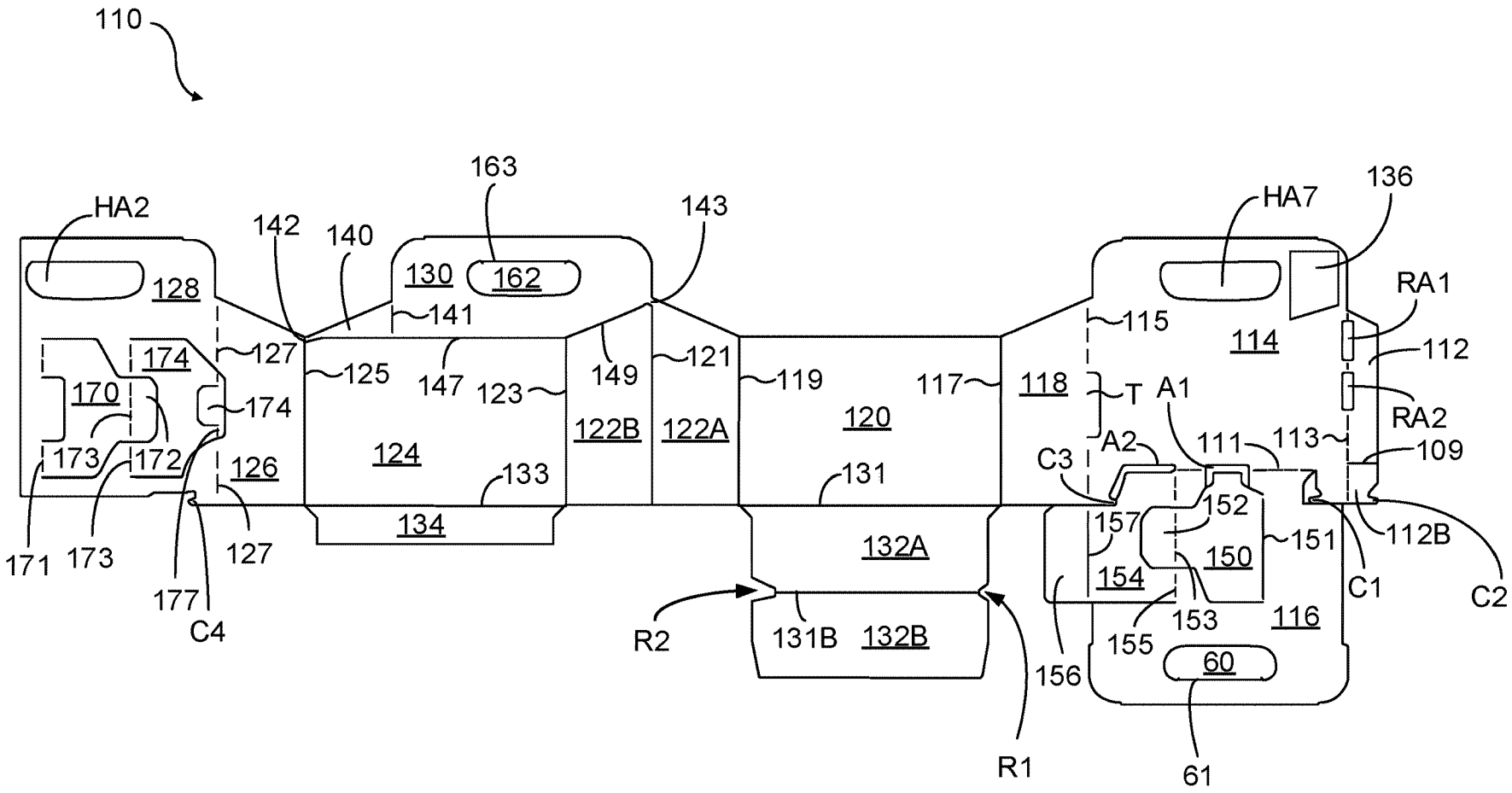
FIG. 8 is a plan view from above of a blank for forming a carrier according to a second embodiment.
Figure 9:
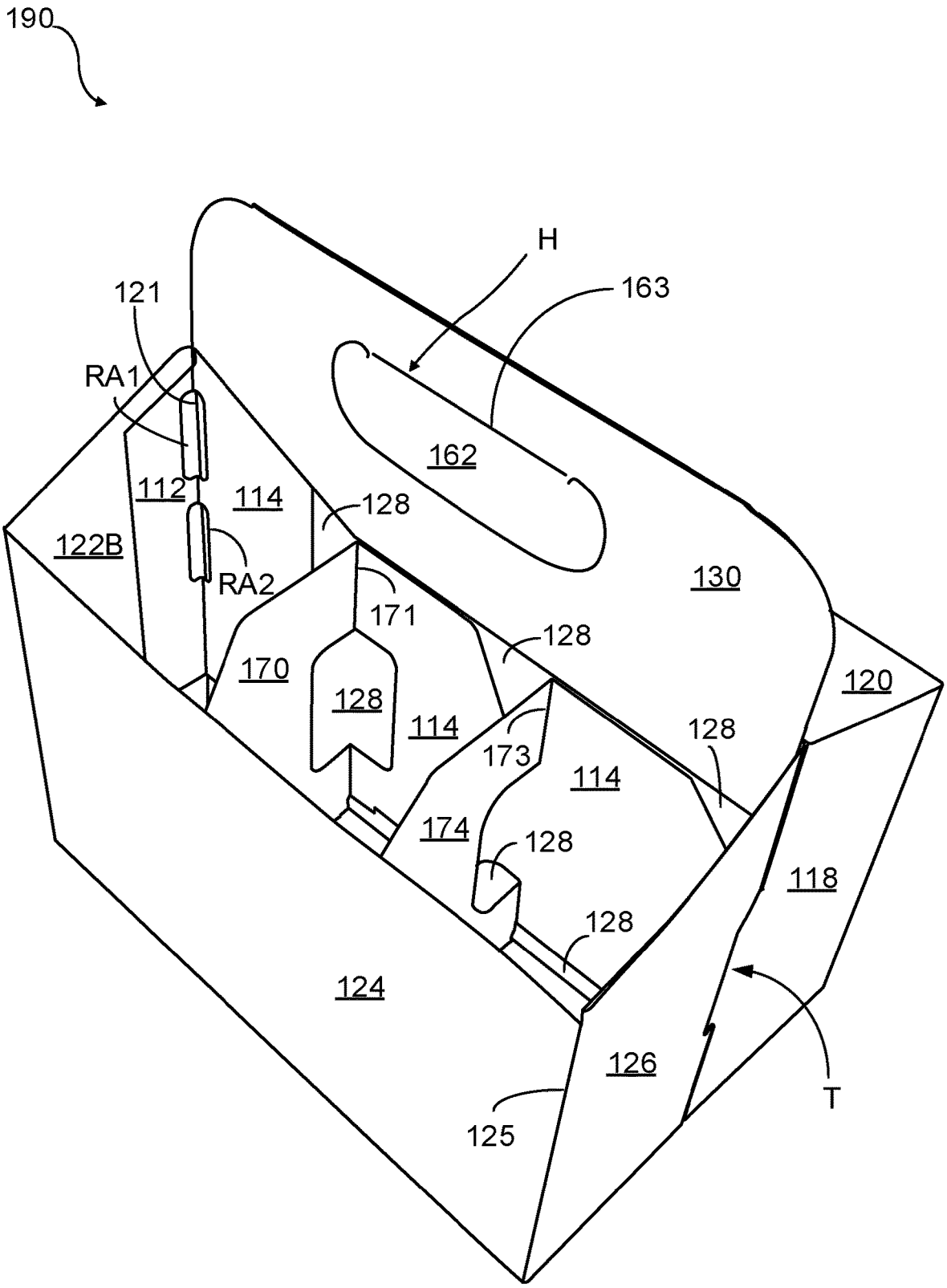
FIG. 9 is a perspective view from above of a front end wall and a first side of a carrier formed from the blank of FIG. 8.

Referring to FIG. 1, there is shown a plan view of a blank 10 capable of forming a carton or carrier 90 having a carrying handle 'H', as shown in FIG. 7, for containing and carrying a group of primary products (not shown), such as, but not limited to, cans or bottles, hereinafter referred to as articles. FIG. 8 illustrates a plan view of alternative blank 110 capable of forming a carton or carrier 190 having a carrying handle 'H', as shown in FIG. 9, for containing and carrying a group of primary products (not shown), such as, but not limited to, cans or bottles, hereinafter referred to as articles.

In the embodiments detailed herein, the terms "carton" and "carrier" refer, for the non-limiting purpose of illustrating the various features of the invention, to a container for engaging and carrying articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10, 110 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the illustrated embodiment, the blanks 10, 110 are configured to form a carton or carrier 90, 190 for packaging an exemplary arrangement of exemplary articles. In the illustrated embodiments, the arrangement is a 2×3 matrix or array and the articles are bottles. Alternatively, the blanks 10, 110 can be configured to form a carrier for packaging other types, number and size of articles and/or for packaging articles in a different arrangement or configuration.

Referring to FIG. 1, the blank 10 comprises a plurality of main panels 14, 18, 20, 22A, 22B, 24, 26, 28 arranged in a linear series, hinged one to the next by hinged connections in the form of fold lines 15, 17, 19, 21, 23, 25, 25, 27. The main panels 18, 20, 22A, 22B, 24, 26 form outer walls of a basket-style carrier 90 (see FIG. 7). The plurality of main panels 14, 18, 20, 22A, 22B, 24, 26, 28 includes a first side panel 20 and a second side panel 24. The first side panel 20 is hinged at a first end to a first end panel 18 by a hinged connection such as a fold line 17. The first side panel 20 is hinged at a second end to a second end panel 22A by a hinged connection such as a fold line 19. The second end panel 22A is hinged at a second end to a third end panel 22B by a hinged connection such as a fold line 21.

The second side panel 24 is hinged at a first end to the third end panel 22B by a hinged connection such as a fold line 23. The second side panel 24 is hinged at a second end to a fourth end panel 26 by a hinged connection such as a fold line 25.

The first end panel 18 and the fourth end panel 26 together form a first end wall of the carrier 90. The second end panel 22A and the third end panel 22B together form a second end wall of the carrier 90.

The blank 10 comprises a first base panel 32, optionally hinged to the first side panel 20 by a hinged connection such as a fold line 31.

The blank 10 comprises a second base panel 34, optionally hinged to the second side panel 24 by a hinged connection such as a fold line 33.

The blank 10 is foldable to form a package 90 as illustrated in FIG. 7. The first and second base panels 32, 34 are engageable with one another in an overlapping relationship to form a composite base wall 32/34 of the carton 90. Optionally, the blank 10 may comprise a complementary locking mechanism for securing the second base panel 34 to the first base panel 32. The first base panel 32 may comprise at least one first part F of the complementary locking mechanism. The second base panel 32 may comprise at least one second part M of the complementary locking mechanism. In the illustrated embodiment, the first base panel 32 comprises a plurality of female tabs F defining openings in the first base panel 32. The second base panel 34 comprises a plurality of male tabs M, the openings in the first base panel 32 being configured to receive a respective one of the male tabs M. The female tabs F are arranged to be displaced out of the first base panel 32 to form the openings and to bear against the male tabs M when received therein. The complementary locking mechanism illustrated and described is entirely optional.

Optionally, the first and second base panels 32, 34 may comprise at least one handling aperture A1, A2. In the illustrated embodiment, each of the first and second base panels 32, 34 comprises three apertures A1, A2. The apertures A1, A2 may be employed to facilitate construction of the carton 90. A packaging machine component may engage with the apertures A1, A2 to enable the first and second base panels 32, 34 to be brought into an overlapping relationship with one another and aligned so as to engage complementary locking mechanism.

The blank 10 comprises an optional handle structure for forming a carrying handle H to enable a user to transport the carrier 90.

The handle structure comprises a first handle panel 14, the first handle panel 14 is hinged to a first end of the first end panel 18 by a hinged connection in the form of a fold line 15. Optionally, the fold line 15 is interrupted by a cutaway in the form of a cutline or severable line 29. The cutline 19 defines at least in part a tab T. The tab T is struck from material which would otherwise form the first handle panel 14. The tab T is integral or unitary with the first end panel 18, that is to say the tab T remains substantially coplanar with first end panel 18 when the first end panel 18 is folded with respect to the first handle panel 14 about fold line 15. The tab T may form a locking element.

The first handle panel 14 is formed from a sheet material having a first surface and a second opposing surface. Optionally, the first handle panel 14 comprises a proud or offset gluing region 36. The offset gluing region 36 comprises a gluing surface which is offset with respect to adjacent regions of the first surface or the second surface or both the first and second surface of the sheet material.

The offset gluing region 36 may be formed as an embossment or debossment of the sheet material. Additionally or alternatively the offset gluing region 36 may be coated or otherwise treated to thicken or displace at least one of the first and second surfaces of the sheet material in the offset gluing region 36. In this way at least one of the first and second surfaces of the sheet material in the offset gluing region 36 stands out in relief with respect to the reminder of said surface of the first handle panel 14.

A securing panel 12 is hinged to a first end of the first handle panel 14 by a hinged connection in the form of a fold line 13. Optionally, the fold line 13 is interrupted by a first cutaway in the form of a first relief aperture RA1 and a second cutaway in the form of a second relief aperture RA2.

The first handle panel 14 comprises a handle cutaway in the form of a first handle aperture HA1.

The handle structure comprises a second handle panel 30. The second handle panel 30 is disposed adjacent to the third end panel 22B and to the second side panel 24. Handle panel 30 is separated from third end panel 22B by a cutline 147. The second handle panel 30 is separated from second side panel 24 by a cutline 145. The second handle panel 30 is connected to second end panel 22A at a first side edge of the second handle panel 30 by a connecting portion 43. The connecting portion 43 is sufficient to maintain the connection between the second handle panel 30 and the second end panel 22A during handling of the blank 10 prior to assembly and optionally during at least a portion of the assembly process.

The handle structure comprises a bridging panel 40, the bridging panel 40 is disposed adjacent to the second side panel 24. A first side edge of the bridging panel 40 is coupled to a second side edge of the second handle panel 30 by a hinged connection in the form of a fold line 41. A second side edge of the bridging panel 40 is coupled to a side edge of the fourth end panel 26 by a connecting portion 42. The connecting portion 42 is sufficient to maintain the connection between the second handle panel 30 and the second end panel 22A during handling of the blank 10 prior to assembly and optionally during at least a portion of the assembly process. The bridging panel 40 is separated from second side panel 24 by the cutline 145.

Optionally, at least a portion of the second handle panel 30 is separated from the second side panel 24 by an aperture A3. Optionally, at least a portion of the second handle panel 30 is separated from the third end panel 22B by the aperture A3.

The second handle panel 30 comprises a handle opening the handle opening may be formed at least in part by a second handle aperture HA3. Optionally, the handle opening may be formed at least in part by a flap 62 struck from the second handle panel 30 and hingedly connected thereto by a fold line 63. The flap 62 may form a cushioning flap for increasing the comfort of the carrying handle when in use.

The blank 10 comprises a partition structure for dividing the interior of the carrier 90 into two or more cells or compartments. The cells may or may not be of uniform size and, optionally in the present arrangement, the partition structure together with the first and second handle panels 14, 30 divide the interior of the basket carrier 90 into six cells arranged in two rows of three cells each.

The partition structure comprises a first partition panel 16 and a second partition panel 28.

The first partition panel 16 is hinged to an end edge, optionally a lower end edge, of the first handle panel 14 by a hinged connection in the form of a fold line 11.

Optionally, the fold line is offset or inset with respect to fold lines 31, 33. In this way the first partition panel 16 is struck from material which would otherwise form the first handle panel 14. The first partition panel 16 does not extend to the composite base panel 32/34 in a setup condition.

The fold line 11, which defines a lowermost edge of the first partition panel 16 is disposed at an elevation above the composite base panel 32/34.

The first partition panel 16 comprises a first handle reinforcing portion having a second handle opening the second handle opening may be formed at least in part by a third handle aperture HA2. Optionally, the second handle opening may be formed at least in part by a second flap 60 struck from the first partition panel 16 and hingedly connected thereto by a fold line 61. The second flap 60 may form a cushioning flap for increasing the comfort of the carrying handle when in use.

Optionally, the first partition panel 16 comprises at least one divider 50/52, 54/56. The illustrated embodiment comprises a pair of dividers 50/52, 54/56, a first divider 50/52 and a second divider 54/56.

The first divider 50/52 comprises a first divider panel 50 and a first securing tab 52. The first divider panel 50 is struck from the first partition panel 16 and is hingedly connected thereto by a fold line 51. The first securing tab 52 is struck from the first partition panel 16 and is hingedly connected to the first divider panel 50 by a fold line 53.

The second divider 54/56 comprises a second divider panel 54 and a second securing tab 56. The second divider panel 54 is struck from the first partition panel 16 and is hingedly connected thereto by a fold line 55. The second securing tab 56 is hingedly connected to the second divider panel 54 by a fold line 57. The second securing tab 56 is disposed adjacent to the first end panel 18 and separated therefrom by a cutline or severable line.

The first securing tab 52 may be struck from the second divider panel 54 so as to be nested or tessellated within the second divider panel 54.

The second partition panel 28 is hinged to a second side edge of the fourth end panel 26 by a hinged connection in the form of a fold line 27. The second side edge of the fourth end panel 26 opposes a first side edge to which the second side panel 24 is hingedly connected.

The first partition panel 16 comprises a first handle reinforcing portion having a fourth handle aperture HA4.

Optionally, the second partition panel 28 comprises at least one divider 70/72, 74/76. The illustrated embodiment comprises a pair of dividers 70/72, 74/76, a third divider 70/72 and a fourth divider 74/76.

The third divider 70/72 comprises a third divider panel 70 and a third securing tab 72. The third divider panel 70 is struck from the second partition panel 28 and is hingedly connected thereto by a fold line 71. The third securing tab 72 is struck from the second partition panel 28 and is hingedly connected to the third divider panel 70 by a fold line 73.

The fourth divider 74/76 comprises a fourth divider panel 74 and a fourth securing tab 76. The fourth divider panel 74 is struck from the second partition panel 28 and is hingedly connected thereto by a fold line 75. The fourth securing tab 76 is hingedly connected to the fourth divider panel 74 by a fold line 77. The fourth securing tab 76 is struck at least in part from the fourth end panel 26 and separated therefrom by a cutline or severable line.

The third securing tab 72 may be struck from the fourth divider panel 74 so as to be nested or tessellated within the fourth divider panel 74.

In some embodiments the dividers 50/52, 54/56, 70/72, 74/76 are omitted, in such embodiments the interior chamber is divided into two cells or compartments by the first handle panel 14, first partition panel 16 and second partition panel 28. Together the first handle panel 14, first partition panel 16 and second partition panel 28 form a medial partition in the interior chamber of the carrier which extends longitudinally across the carrier 90. This arrangement may be advantageously employed with non-fragile articles for example but not limited to non-glass articles such as plastic or aluminium articles; the omission of the dividers 50/52, 54/56, 70/72, 74/76 reduces the complexity of the carrier and assembly process, it removes or eliminates gluing steps from the assembly process and simplifies handling of the blank 10 by reducing the number of foldable or displaceable features provided therein.

Figure 2:
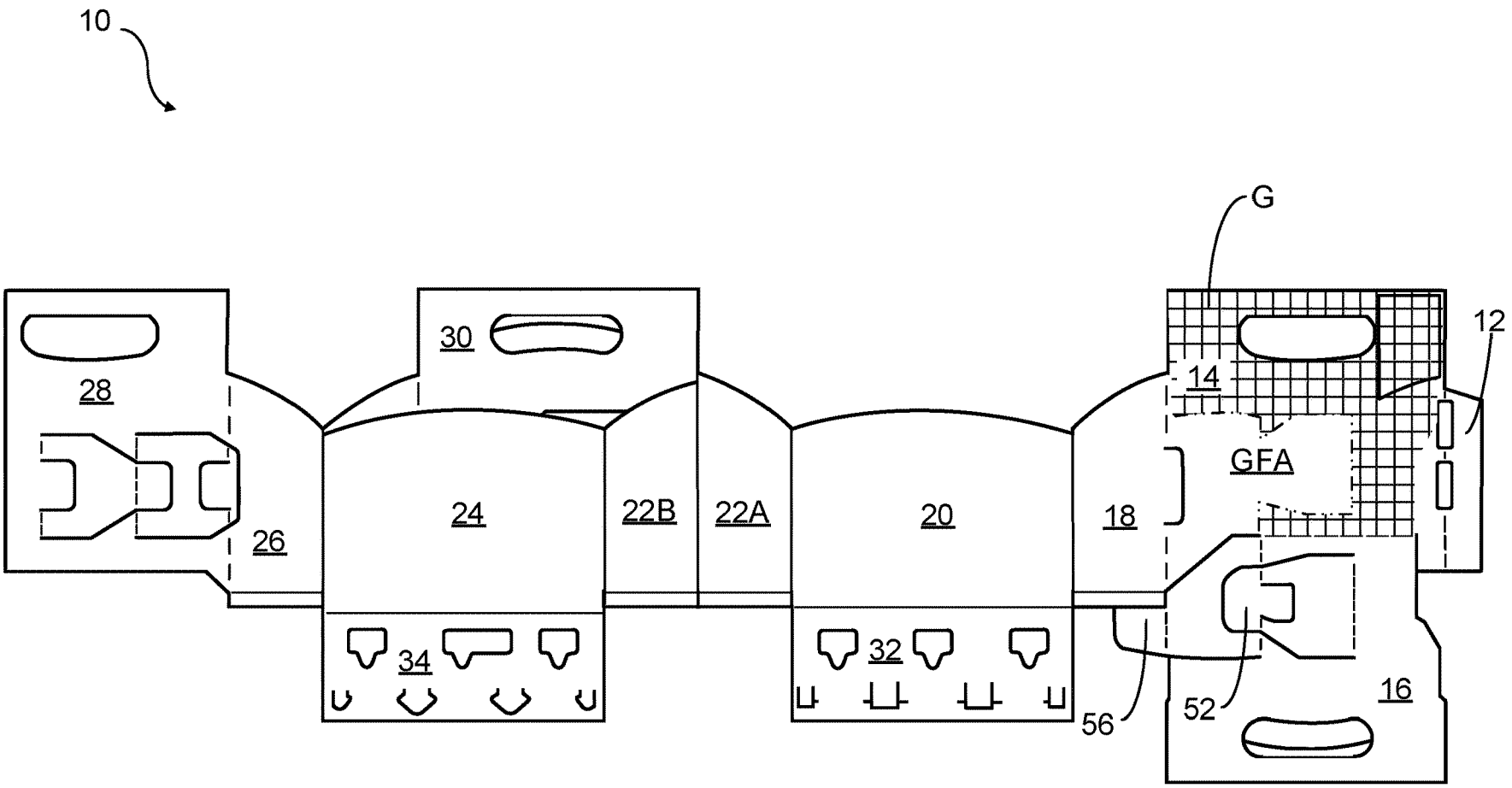
FIGS. 2 to 5 and 6 are plan views from above of the blank during sequential stages of construction of the blank of FIG. 1 into a carrier.
Figure 3:
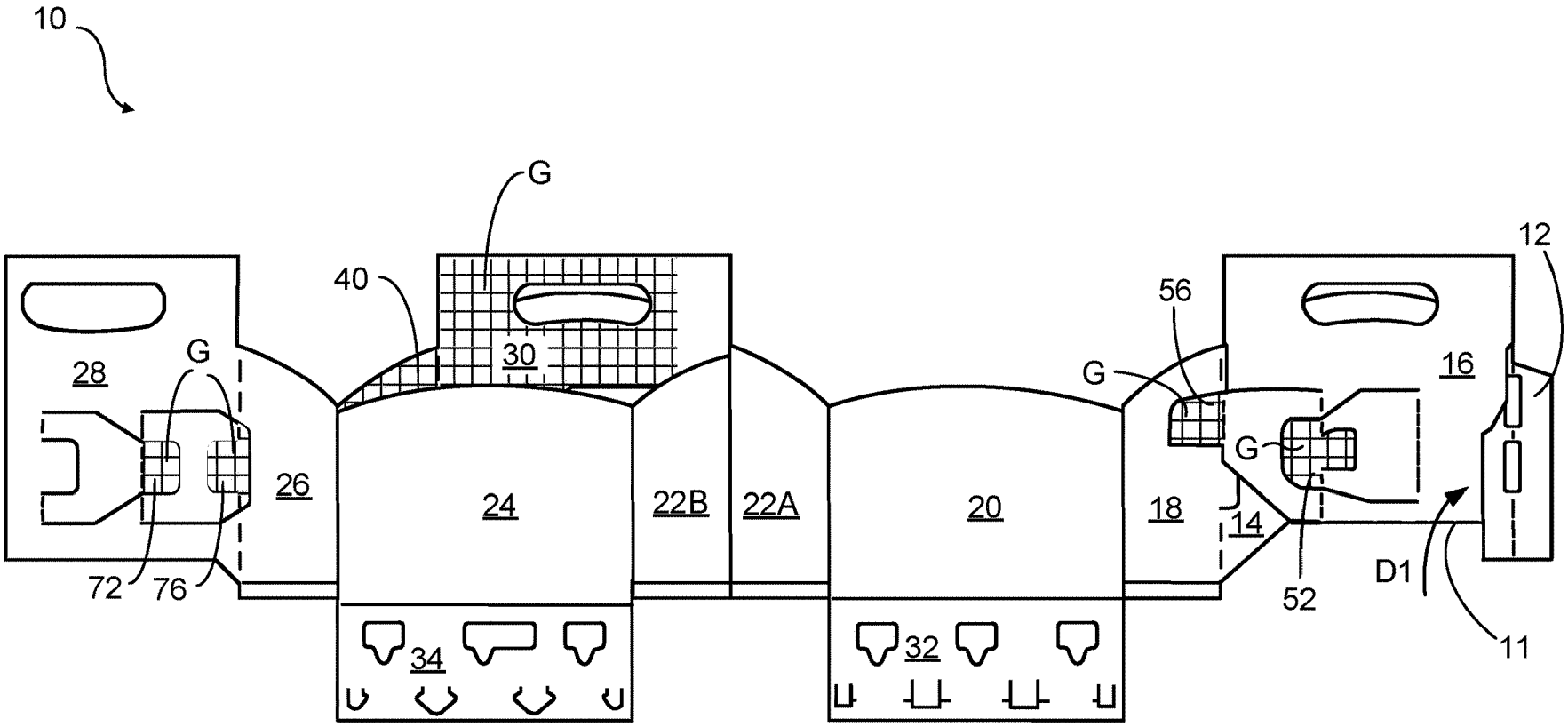
Figure 4:
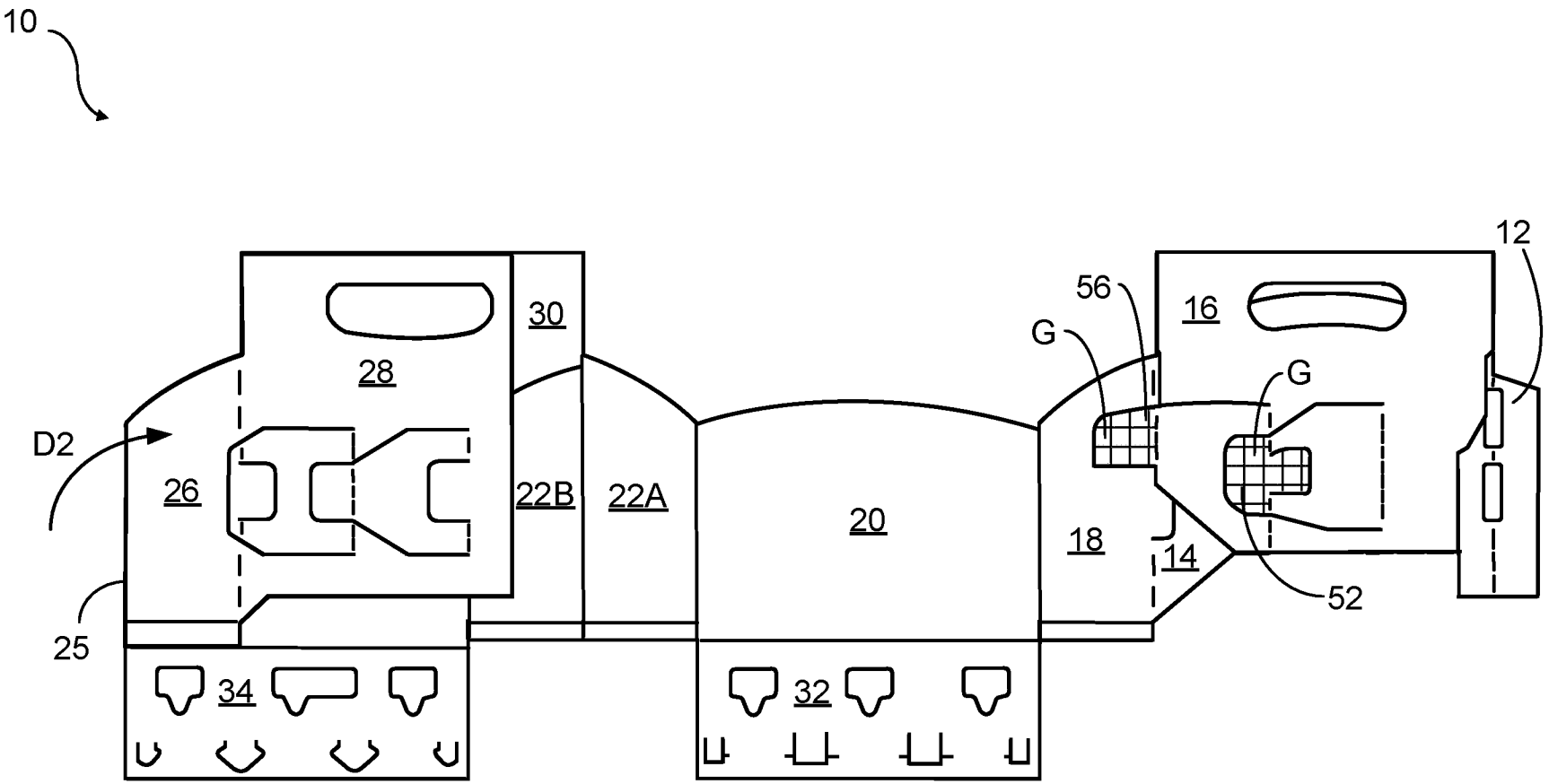

Turning to the construction of the carrier 90 from the blank 10 as illustrated in FIGS. 2 to 6, glue G or other adhesive treatment is applied a region of the inside surface of the first handle panel 14, see FIG. 2. The region corresponds to a location that the first partition panel 16 will occupy once the blank 10 is folded so that the first partition panel 16 is in face contacting relationship with the first handle panel 14. The region of the inside surface of the first handle panel 14 to which glue or adhesive treatment is applied excludes an area GFA which the first and second dividers 50/52, 54/56 will occupy once the blank 10 is folded so that the first partition panel 16 is in face contacting relationship with the first handle panel 14. Area GFA of the first handle panel 14 is a glue free area, in some embodiments it may be treated or coated with a substance to prevent or inhibit adhesion such as an abhesive. In this way the first partition panel 16 can be secured to the first handle panel 14 whilst the first and second dividers 50/52, 54/56 are unsecured or free from the first handle panel 14.

It will be appreciated that the glue G or other adhesive treatment may be applied the inside surface of the first partition panel 16, excluding the first and second dividers 50/52, 54/56.

The blank 10 is then folded about the fold line 11, as indicated by direction arrow D1 (shown in FIG. 3), to bring the first partition panel 16 into face contacting relationship with the first handle panel 14.

The first partition panel 16 is secured to the first handle panel 14.

Glue G or other adhesive treatment is applied to the third and fourth securing tabs 72, 76 or to corresponding regions of the second side panel 24 in which the third and fourth securing tabs 72, 76 will be brought into face contacting relationship.

Glue G or other adhesive treatment is applied to the second handle panel 30 and to the bridging panel 40 or to corresponding regions of the second partition panel 28 and fourth end panel 26 in which the second handle panel 30 and the bridging panel 40 will be brought into face contacting relationship respectively.

The blank 10 is then folded about the fold line 25, as indicated by direction arrow D2 (shown in FIG. 4), to bring the second partition panel 16 into face contacting relationship with the second handle panel 30 and the second side panel 24. The fourth end panel 26 is brought into face contacting relationship with the bridging panel 40 and the second side panel 24.

The second partition panel 28 is secured to the second handle panel 30.

The fourth end panel 26 is secured to the bridging panel 40

Glue or other adhesive treatment is applied to the first and second securing tabs 52, 56 or to corresponding regions of the first side panel 20 in which the first and second securing tabs 52, 56 will be brought into face contacting relationship.

Figure 5:
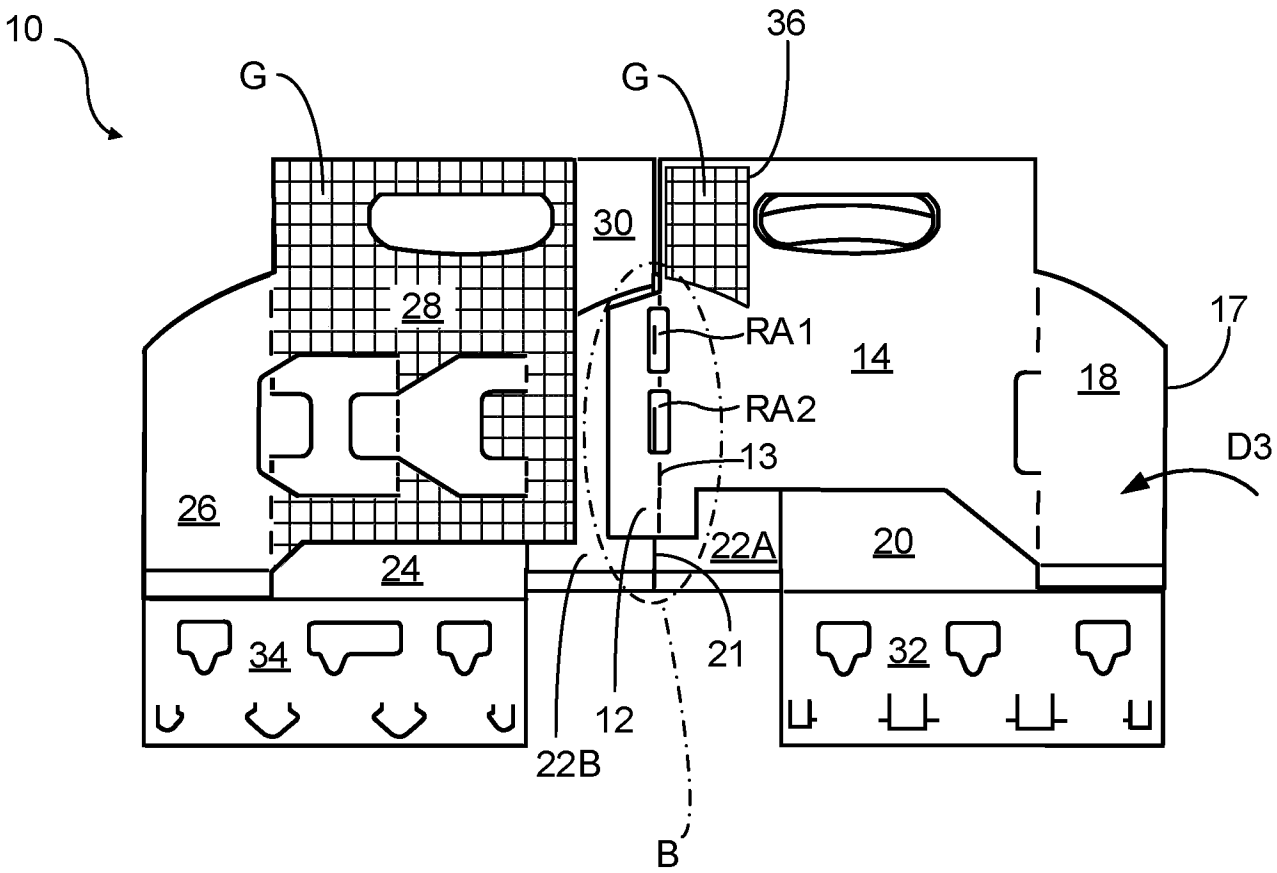

The blank 10 is then folded about the fold line 17, in the direction as indicated by arrow D3 in FIG. 5, to bring the first partition panel 16 and second securing tab 56 into face contacting relationship with the first side panel 20.

The first end panel 18 is brought into face contacting relationship with the first side panel 20.

The first partition panel 16 and the first handle panel are brought into overlying relationship with the first side panel 20 and the second end panel 22A.

The securing panel 12 is brought into face contacting relationship with the second end panel 22A.

The securing panel 12 is secured to the second end panel 22A.

The first and second securing tabs 52, 56 are secured to the first side panel 20.

Figure 5B:
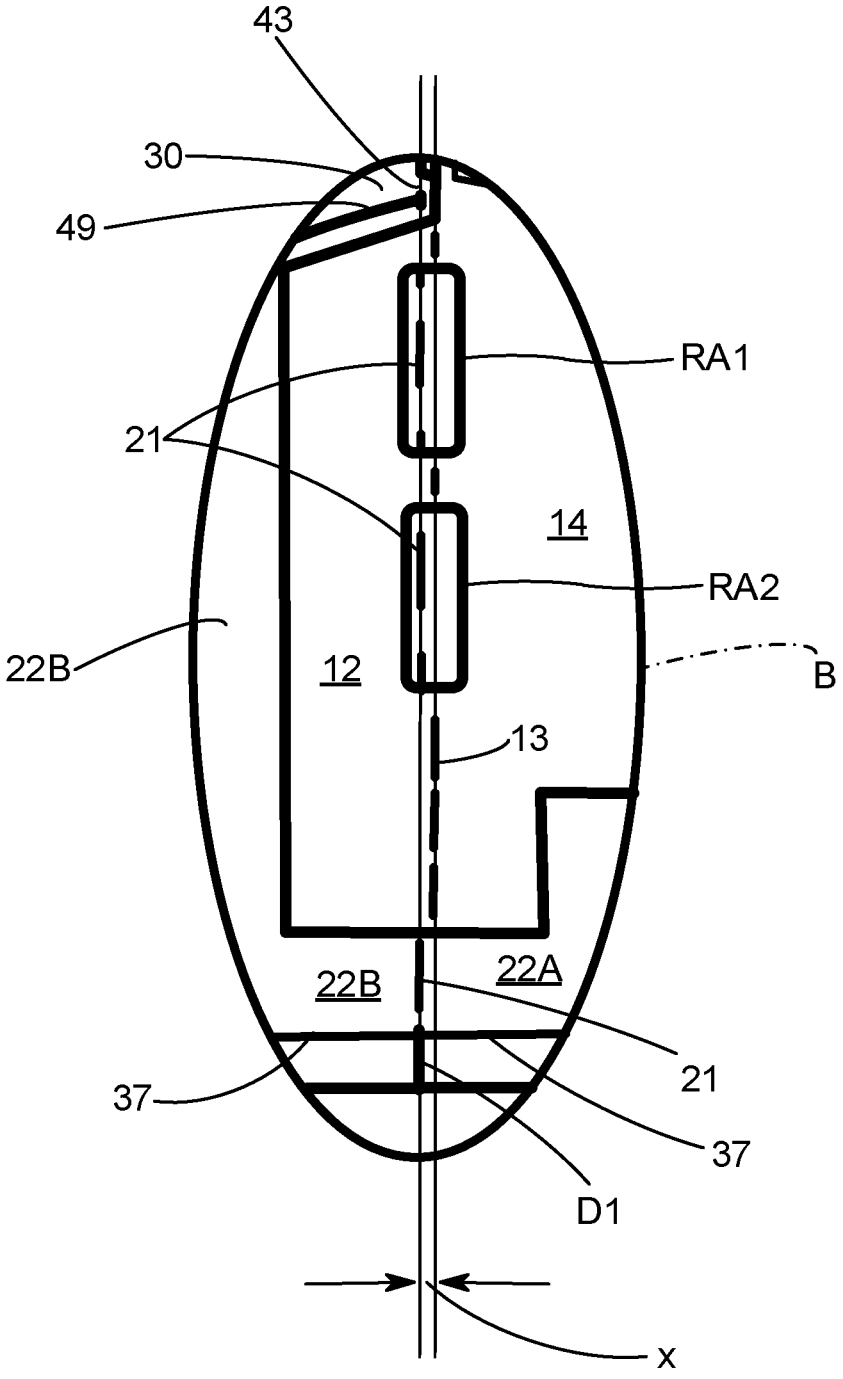
FIG. 5B is an enlarged view of an area B shown in FIG. 5.

In the illustrated embodiment, the securing panel 12, first handle panel 14 and fold line 13 are arranged such that fold line 13 is offset with respect to the fold line 21 hinging the second and third end panels 22A, 22B. The offset distance x (see FIG. 5B) may be in the range 0.75 mm to 3 mm. In the illustrated embodiment the fold line 13 is offset such that fold line 13 is disposed closer to fold line 15 than it would be if the fold line 13 was configured to be in vertical registry with fold line 21 when blank 10 is folded as shown in FIG. 5. This may have the effect of shortening the first handle panel 14 with respect to the first side panel 20.

The optional first and second relief apertures RA1, RA2 are arranged so as to overlie the fold line 21. Parts of the fold line 21 are visible through first and second relief apertures RA1, RA2 in FIGS. 5 and 5B.

Figure 6:
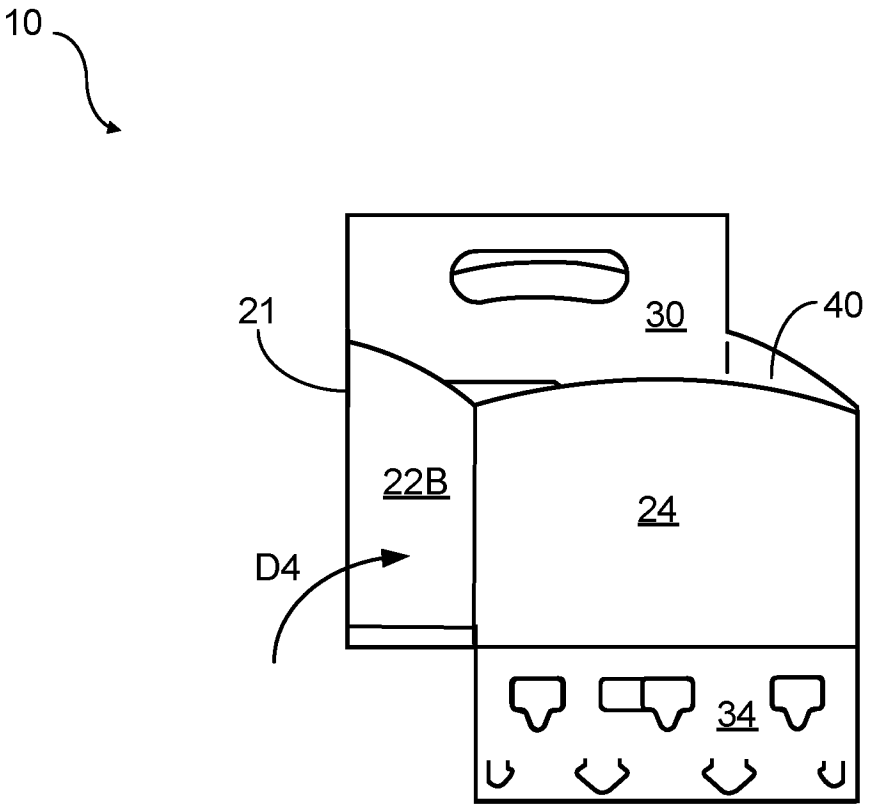

Offsetting the fold line 13 with respect to the fold line 21 may reduce the folding resistance of the blank 10 when folding the blank 10 as shown in FIG. 6.

Additionally or alternatively, provision of the first and second relief apertures RA1, RA2, when provided, may reduce the folding resistance of the blank 10 when folding the blank 10 as shown in FIG. 6.

In this way less force is required to fold the blank 10 as shown in FIG. 6 than would be required otherwise.

The offset nature of the fold line 13 with respect to the fold line 21 also improves the alignment of the first and second handle panels 14, 30 with respect to each other and with respect to each of the first and second partition panels 16, 28. In this way first and second handle panels 14, 30 and the first and the second partition panels 16, 28 are arranged substantially in registry with each when assembled, thus improving the aesthetic quality of the carrier 90.

The ply of sheet material comprising the fold line 13, when folded defines an edge. The edge may serve as an alignment guide. The edge may serve as a mandrel facilitating the folding of the ply of sheet material comprising the fold line 21.

To complete the construction of the blank 10, glue G or other adhesive treatment is applied to the upwardly facing surface of the second partition panel 28, excluding the third and fourth dividers 70/72, 74/76 such that the upwardly facing surface of the third and fourth dividers 70/72, 74/76 is glue free.

Glue G or other adhesive treatment is applied to the upwardly facing surface of the first handle panel 14 in the embossed region 36. By embossing the region 36 better adhesion between the first handle panel 14 and the second handle panel 30 may be achieved. The second partition panel 28 is disposed between the first handle panel 14 and the second handle panel 30 and has the effect of spacing the first handle panel 14 and the second handle panel 30 apart. The embossed region 36 reduces or eliminates the spacing between the first handle panel 14 and the second handle panel 30 in the region where the first handle panel 14 is secured directly to the second handle panel 30. It will be appreciated that the glue G or other adhesive treatment may be applied to the portion of the second handle panel 30 to which the embossed region 36 is to be secured instead or in addition to treatment of the embossed region 36 of the first handle panel 14.

The blank 10 is then folded, as shown by direction arrow D4 in FIG. 6, about the fold line 21 to bring the second side panel 24 into overlying relationship with the first side panel 20.

The second partition panel 28 is brought into face contacting relationship with the first handle panel 14.

The second partition panel 28 is secured to the first handle panel 14. The second handle panel 130 is secured to the embossed region 36 of the first handle panel 114.

A flat collapsed carrier is thereby formed, as shown in FIG. 6, the flat collapsed carrier can be readily shipped or distributed in the flat condition to a plant for erecting and loading with primary product containers.

The flat collapsed carrier can be opened into a basket-style article carrier by separating the first and second side panels 20, 20 to form a tubular structure defined by the main panels 18, 20, 22A, 22B, 24, 26. The main panels 18, 20, 22A, 22B, 24, 26 define an interior chamber. The partition structure is automatically erected when the flat collapsed carrier is opened out or erected into the tubular form.

Once the carrier 90 is erected, the first and second handle panel 14, 30 and the first and second partition panels 16, 28 (form a medial partition structure CP, see FIG. 7, that is disposed medially and in part within the interior of the carrier 90 formed by the main panels 18, 20, 22A, 22B, 24, 26. The medial partition structure CP divides the interior of the carrier 90 into two separate cells. The first and second handle panel 14, 30 and the first and second partition panels 16, 28 are disposed in a layered arrangement, with the first handle panel 14 and the second partition panel 28 sandwiched between the first partition panel 16 and the second handle panel 30. As such the first partition panel 16 and the second handle panel 30, with their associated cushioning flaps 60, 62, are disposed outermost.

The flat collapsed carrier comprises opposed end walls 18/26, 22A/22B which are in a folded condition in the flat collapsed state. The first end wall 18/26 comprises a pair of fold lines 15, 27 coupling the first and fourth end panels 18, 26 to the medial partition structure CP. The second end wall 22A/22B comprises a fold line 21 coupling the second and third end panels 22A, 22B to each other. Typically in the flat collapsed state the first and fourth end panels 18, 26 are disposed in face to face relationship with each such that the fold line 15, 27 are in an unfolded condition, whereas the second end wall 22A/22B is folded such that medial partition structure CP is disposed between the second and third end panels 22A, 22B and the fold line 21 is in a folded condition.

Once the carrier 90 is erected into a tubular form the carrier can be loaded with articles (not shown) an article may be inserted into each cell and the partition structure separates each article from its adjacent neighbours. The carrier 90 may be bottom loaded that is to say the articles are received in the interior chamber via a lower open end adjacent the base panels 32, 34.

Once loaded the first and second base panels 32, 34 are folded about fold lines 31, 33 respectively and brought into at least partial overlapping relationship with each other. The first base panel 32 is disposed innermost. The first and second base panels 32, 34 are then secured to each other employing the complementary locking mechanism.

It will be appreciated that the composite base wall 32/34 may be assembled prior to loading. The carrier 90 may then be top-loaded, the articles are received in the interior chamber via an upper open end adjacent the carrying handle H.

When the carrier 90 is assembled into the erected form the blank 10 may be manipulated such that the tab T passes through an opening in the second end wall 18/26 which is created by when a portion of the fourth securing tab 76 struck from the fourth end panel 26 is displaced from the fourth end panel 26, as shown in FIG. 7. The tab T may serve as a locking feature preventing or inhibiting the tendency of the blank 10 to return to the flat collapsed state—due to the inherent resilience of the sheet material which encourages the blank 10 to return to the state illustrated in FIG. 6.

Referring now to FIGS. 8 and 9, there is shown an additional embodiment of the present disclosure. In the second illustrated embodiment like numerals have, where possible, been used to denote like parts, albeit with the addition of the prefix "100" to indicate that these features belong to the second embodiment. The additional embodiment shares many common features with the first embodiment and therefore only the differences from the embodiment illustrated in FIGS. 1 to 7 will be described in detail.

Referring to FIG. 8, there is shown a second illustrated embodiment of a blank 110, the blank 110 comprises a plurality of main panels 114, 118, 120, 122A, 122B, 124, 126, 128 arranged in a linear series, hinged one to the next by hinged connections in the form of fold lines 115, 117, 119, 121, 123, 125, 125, 127. The main panels 118, 120, 122A, 122B, 124, 126 form outer walls of a basket-style carrier 190 (see FIG. 9). The plurality of main panels 114, 118, 120, 122A, 122B, 124, 126, 128 includes a first side panel 120 and a second side panel 124. The first side panel 120 is hinged at a first end to a first end panel 118 by a hinged connection such as a fold line 117. The first side panel 120 is hinged at a second end to a second end panel 122A by a hinged connection such as a fold line 119. The second end panel 122A is hinged at a second end to a third end panel 122B by a hinged connection such as a fold line 121.

The second side panel 124 is hinged at a first end to the third end panel 122B by a hinged connection such as a fold line 123. The second side panel 124 is hinged at a second end to a fourth end panel 126 by a hinged connection such as a fold line 125.

The first end panel 118 and the fourth end panel 126 together form a first end wall of the carrier 190. The second end panel 122A and the third end panel 122B together form a second end wall of the carrier 190.

The blank 110 comprises a base panel 132A/132B, hinged to the first side panel 120 by a hinged connection such as a fold line 131. The base panel 132A/132B comprises a first part 132A hinged to a second part 132B by a fold line 131B. A first recess or cutaway R1 is struck from a first side edge of base panel 132A/132B, the first recess R1 interrupts the fold line 131B such that a first end of the fold line 131B terminates at first recess R1. A second recess or cutaway R2 is struck from a second, opposing side edge of base panel 132A/132B, the second recess R2 interrupts the fold line 131B such that a second end of the fold line 131B terminates at second recess R2. The first and second recesses R1, R2 form first parts of a securing mechanism.

The blank 110 comprises a securing flap 134, hinged to the second side panel 124 by a hinged connection such as a fold line 133. The securing flap 134 is configured to be secured to the second part 132B of base panel 132A/132B along a free end edge opposing the fold line 131B.

The blank 110 comprises a partition structure including a first partition panel 116 and a second partition panel 128.

The first partition panel 116 is hinged to an end edge, optionally a lower end edge, of the first handle panel 114 by a hinged connection in the form of a fold line 111.

Optionally, the fold line is offset or inset with respect to fold lines 131, 133. In this way the first partition panel 116 is struck, at least in part, from material which would otherwise form the first handle panel 114. The first partition panel 116 does not extend to the base panel 132A/132B in a setup condition. The fold line 111, which defines a lowermost edge of the first partition panel 116 is disposed at an elevation above the composite base panel 132A/132B.

The first partition panel 116 comprises at least one divider 150/152, 154/156. The illustrated embodiment comprises a pair of dividers 150/152, 154/156, a first divider 150/152 and a second divider 154/156.

The first divider 150/152 comprises a first divider panel 150 and a first securing tab 152. The first divider panel 150 is struck from the first partition panel 116 and is hingedly connected thereto by a fold line 151. The first securing tab 152 is struck from the first partition panel 116 and is hingedly connected to the first divider panel 150 by a fold line 153.

The second divider 154/156 comprises a second divider panel 154 and a second securing tab 156. The second divider panel 154 is struck from the first partition panel 116 and is hingedly connected thereto by a fold line 155. The second securing tab 56 is hingedly connected to the second divider panel 154 by a fold line 157. The second securing tab 156 is disposed adjacent to the first end panel 118 and separated therefrom by a cutline or severable line.

The first securing tab 152 may be struck from the second divider panel 154 so as to be nested or tessellated within the second divider panel 154.

The second partition panel 128 is hinged to a second side edge of the fourth end panel 126 by a hinged connection in the form of a fold line 127. The second side edge of the fourth end panel 126 opposes a first side edge to which the second side panel 124 is hingedly connected.

Due to the inset arrangement of fold line 111 with respect to fold lines 131, 133 the first and second divider panel 150,154 are shorter than they would be if fold line 111 were arranged to be collinear with fold lines 131, 133.

Insetting the fold 111 has the effect of reducing the footprint of the blank 110, reducing the height of the blank 110, this is advantageous in maximizing the number of blanks 110 which may be cut from a sheet of paperboard material.

In order to overcome the effect of shortening the divider panels 150,154, the divider panels 150,154 are arranged to extend to the edge of the first partition panel 116, up to the fold line 111. The divider panels 150,154 may interrupt the fold line 111. The divider panels 150,154 may be arranged so as to interrupt the fold line 111 so as to be struck in part from the first handle panel 114. The divider panels 150,154 may therefore be disposed in close proximity to the first handle panel 114. In order that the first handle panel 114 is readily folded with respect to the first partition panel 116 the blank 110 comprises a first cutaway A1 and a second cutaway A2. In the illustrated embodiment the first and second cutaways A1, A2 interrupt the fold line 111. The first and second cutaways A1, A2 provide a clearance distance between the divider panels 150,154 and the first handle panel 114, this prevents or reduces the likelihood of the divider panels 150,154 catching or snagging upon the first handle panel 114 during the folding process.

Lengthening the divider panels 150,154 may be advantageous in that the divider panels 150,154 are capable of separating or spacing apart the heels or bases of a pair of adjacent articles disposed on opposing side of a one of the divider panels 150,154.

The first partition panel 116 comprises a first handle reinforcing portion having a handle opening; the handle opening is defined by a cushioning flap 160; the cushioning flap 160 is struck from the first partition panel 116 and hingedly connected thereto by a fold line 161. The cushioning flap 160 may increase the comfort of the carrying handle when in use.

The second handle panel 130 comprises a handle opening; the handle opening is defined by a second cushioning flap 162; the second cushioning flap 162 is struck from the second handle panel 130 and hingedly connected thereto by a fold line 163. The cushioning flap 162 may increase the comfort of the carrying handle when in use.

The blank 110 comprises a first hook or catch C1. The first catch C1 is provided by the first handle panel 114.

The blank 110 comprises a second hook or catch C3. The second catch C3 is provided by the first handle panel 114.

The first catch C1 is engageable with the second recess R2 and forms a complementary second part of the securing mechanism.

The second catch C3 is engageable with the first recess R1 and forms a complementary second part of the securing mechanism.

The blank 110 comprises a first catch reinforcement C2. The first catch reinforcement C2 is provided by a lower portion of the securing panel 112. The first catch reinforcement C2 is defined in part by a cutline or severable line 109 extending from fold line 113, transversely, to a free side edge of the securing panel 112. The first catch reinforcement C2 is hingedly connected to the first handle panel 114 by a portion of fold line 113. The first catch reinforcement C2 is secured to the adjacent portion of the first handle panel 114 in face contacting relationship so as to reinforce the first catch C1.

The blank 110 comprises a second catch reinforcement C4. The second catch reinforcement C4 is provided by a lower portion of the second partition panel 128 proximate the fourth end panel 126. The second catch reinforcement C4 is defined in part by a cutaway or recess struck from a free edge of the second partition panel 128. The second catch reinforcement C4 is secured to the second catch C3 provided by the first handle panel 114 and in face contacting relationship therewith so as to reinforce the second catch C3.

The blank 110 is foldable to form a flat collapsed carrier in a substantially similar manner to that described above in relation to the embodiment of FIGS. 1 to 7. However, the second part 132B of the base panel 132A/132B is folded with respect to the first part 132A of the base panel 132A/132B, about fold line 131B. The second part 132B of the base panel 132A/132B is secured for example with adhesive to the securing flap 134.

At the stage when glue or adhesive treatment is applied to the second partition panel 128 and the embossed region 136, glue or other adhesive treatment may also be applied to the first catch reinforcement C2 (or corresponding adjacent portion of the first handle panel 114) and to the securing flap 134 or (or corresponding portion of the second part 132B of the base panel 132A/132B) prior to folding the blank 110 about fold line 121 (and fold line 113).

The blank 110 is then subsequently folded about fold line 121 (and fold line 113) to bring the second side panel 124 into overlying relationship with the first side panel 120.

The second partition panel 128 is brought into face contacting relationship with the first handle panel 114.

The second partition panel 128 is secured to the first handle panel 114. The second handle panel 130 is secured to the embossed region 136 of the first handle panel 114. The second part 132B of the base panel 132A/132B is secured to the securing flap 134. The first catch reinforcement C2 is secured to the adjacent portion of the first handle panel 114 comprises the first catch C1.

A flat collapsed carrier is thereby formed, the flat collapsed carrier can be readily shipped or distributed in the flat condition to a plant for erecting and loading with primary product containers.

The flat collapsed carrier is manipulable to form a package 190 as illustrated in FIG. 9. The base panel 132A/132B along with the partition structure are automatically erected when the flat collapsed blank 110 is erected to form a tubular structure.

In the embodiment of FIG. 9 the tab T remains internal of the outer walls of the carrier 190. The tab T forms a space or gap filler, it blocks or covers the opening in the end wall 118/126 created when the portion of the securing tab 174 struck from the fourth end panel 126 is displaced out of the plane of the fourth end panel 126 during the erection process. Alternatively, the tab T may be manipulated to be external of the fourth end panel 126 so as to form a locking feature in a similar manner to that described in relation to the embodiment of FIGS. 1 to 7.

It can be appreciated that various changes may be made within the scope of the present invention. For example, the size and shape of the panels and apertures may be adjusted to accommodate articles of differing size or shape. The carrier may be configured and arranged to package a different number of articles. In such embodiments the carrier may comprise an alternative number of partition structures so as to separate adjacent articles.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carrier comprising a plurality of main panels forming outer walls and defining an interior chamber, the plurality of main panels comprising a first side panel, a second side panel, first end panel, second end panel, third end panel and fourth end panel, the first and fourth end panels forming a first end wall of the carrier, the second and third end panels forming a second end wall of the carrier, the second end panel being hingedly connected to the third end panel by a first fold line, the interior chamber divided into two or more cells by a partition structure, the partition structure comprising a handle panel hingedly connected along a first side edge to the first end panel, the partition structure further comprising a securing panel hingedly connected to the handle panel along a second opposing side edge by a second fold line and wherein a partition panel is coupled to the fourth end panel, the handle panel, and the partition panel together forming a medial partition and each comprising a handle opening for forming a carrying handle in the medial partition, the securing panel being secured to the third end panel wherein the second fold line is offset from the first fold line, when the carrier is in a flat collapsed form.

2. A carrier according claim 1 wherein the second fold line is interrupted by at least one aperture or cutaway, the cutaway being disposed in overlying relationship with the first fold line when the carrier is in a flat collapsed form.

3. A carrier according claim 1 wherein the second fold line is offset from the first fold line by a distance x, where the distance x is in the range 0.75 mm to 3 mm.

4. A carrier according claim 1 wherein the partition panel is hingedly connected to the fourth end panel.

5. A carrier according claim 1 wherein the partition panel is hingedly connected to a bridging panel, the bridging panel being secured to the fourth end panel, and at least in blank form hingedly connected thereto.

6. A carrier according claim 1 comprising a further partition panel hingedly connected to the handle panel along an end edge of the handle panel adjacent the first and second side edges.

7. A carrier according claim 4 comprising a further handle panel hingedly connected to a bridging panel, the bridging panel being secured to the fourth end panel, and at least in blank form hingedly connected thereto.

8. A carrier according claim 1 wherein the first partition panel comprises at least one divider, wherein the at least one divider comprises a divider panel hingedly connected to the first partition panel and struck, at least in part, therefrom, and a securing tab hingedly connected to the divider panel.

9. A carrier according to claim 1 comprising a first base panel hingedly connected to the first side panel.

10. A carrier according claim 9 comprising at least one of: (i) a second base panel and (ii) a securing flap, hingedly connected to the second side panel.

11. A carrier according to claim 1 comprising a second handle panel hingedly connected to the second end panel and to the fourth end panel by a bridging panel.

12. A carrier according to claim 1 wherein the first handle panel comprises a cutaway struck therefrom and separating or spacing apart the divider panel from the first handle panel; the divider panel being struck in part from the first handle panel.

13. A carrier according to claim 1 wherein the first handle panel comprises a first catch, defined by a recess, the securing panel comprising a first catch reinforcement defined by a recess, the first catch reinforcement hingedly connected to the first handle panel adjacent the first catch and severable from an upper portion of the securing panel by a severable line.

14. A carrier according to claim 11 wherein the first handle panel comprises an embossed region for being adhered directly to the second handle panel.

15. A carrier according to claim 11 wherein the second partition panel is shorter in a longitudinal direction than the first or second handle panels.

16. A carrier according to claim 1 wherein the first end panel comprises a locking tab struck from an adjacent portion of the first handle panel to which the first end panel is hinged, and the fourth end panel comprises an opening for receiving the locking tab.

17. A carrier according to claim 16 wherein the opening is defined by a portion of a divider, said portion being struck from the fourth end panel.

18. An article carrier comprising:

a tubular structure having a plurality of outer walls defining an interior volume for receiving one or more articles, the plurality of outer walls including first and second opposed side walls, first and second opposed end walls and a base wall;

a medial partition structure coupled to the tubular structure; and a carrying handle formed in the medial partition structure, wherein the medial partition is formed from at least two plies, a first ply provided by a first handle panel and a second ply provided by a first partition panel, the first partition panel hinged to a lower edge of the first handle panel, the first partition panel comprising at least one divider, wherein the at least one divider comprises a divider panel hingedly connected to the first partition panel and struck, at least in part, therefrom, and a securing tab hingedly connected to the divider panel, first handle panel comprising a cutaway struck therefrom and separating or spacing apart the divider panel from the first handle panel.

19. An article carrier according to claim 18 wherein the divider panel is struck in part from the first handle panel.

20. An article carrier comprising:

a tubular structure having a plurality of outer walls defining an interior volume for receiving one or more articles, the plurality of outer walls including first and second opposed side walls, first and second opposed end walls and a base wall;

a medial partition structure coupled to the tubular structure; and a carrying handle formed in the medial partition structure;

wherein the medial partition is formed from at least three plies, a first ply provided by a first handle panel, a second ply provided by a partition panel and a third ply provided by a second handle panel, the partition panel being disposed between a first portion of the first handle panel and a first portion of the second handle panel and a second portion of the of the first handle panel and a second portion of the second handle panel are secured directly to each other, one of the first and second handle panels comprising an embossed region disposed in face contacting relationship with a corresponding region of the other of the first and second handle panels.

* * * * *